United States Patent [19]

Silvia, Jr.

[11] Patent Number: 4,905,622

[45] Date of Patent: Mar. 6, 1990

[54] MARINE ANTI-ROLL DEVICE

[76] Inventor: Joseph G. Silvia, Jr., 60 Dixon St., Newport, R.I. 02840

[21] Appl. No.: 191,835

[22] Filed: May 9, 1988

Related U.S. Application Data

[63] Continuation-in-part of Ser. No. 054,838, May 27, 1987, abandoned.

[51] Int. Cl.[4] ..... B63B 39/00

[52] U.S. Cl. ..... 114/122; 114/126; 114/245; 114/311

[58] Field of Search ..... 114/121, 122, 126, 242, 114/244, 245, 253, 254, 311, 312, 330–332, 294, 39

[56] References Cited

U.S. PATENT DOCUMENTS

| | | | |
|---|---|---|---|
| 1,299,186 | 1/1919 | Imaizumi | 114/122 |
| 2,561,539 | 7/1951 | Seward | 114/126 |
| 2,561,599 | 7/1951 | Seward | 114/126 |
| 2,589,312 | 3/1952 | Wilcoxon | 114/235 |
| 3,062,171 | 11/1962 | Somerville | 114/245 |
| 3,065,722 | 11/1962 | Green | 114/245 |
| 3,226,114 | 12/1965 | Swider | 114/311 |
| 3,260,232 | 7/1966 | Douglas | 114/126 |
| 3,372,666 | 3/1968 | Baker | 114/245 |
| 3,505,968 | 4/1970 | Gorman | 114/126 |
| 3,531,761 | 9/1970 | Tickell | 114/245 |
| 3,560,912 | 2/1971 | Spink | 114/245 |
| 3,589,324 | 6/1971 | Hoffman | 114/122 |
| 3,952,680 | 4/1976 | Griffin | 114/122 |
| 4,019,453 | 4/1977 | Boswell | 114/245 |
| 4,061,102 | 12/1977 | Bissett | 114/122 |
| 4,748,927 | 6/1988 | Bujacich | 114/122 |

*Primary Examiner*—Joseph F. Peters, Jr.
*Assistant Examiner*—Clifford T. Bartz
*Attorney, Agent, or Firm*—Daniel H. Kane, Jr.

[57] ABSTRACT

A system for reducing roll of vessels comprises at least one and preferably a pair of hydrofoil devices suspended from lines rigged on each side of the vessel, preferably from outrigger booms. The devices are asymmetrical foils which are arranged to provide a downwardly acting hydrodynamic force as the devices move with respect to the water. The center of the hydrodynamic force, the center of gravity of the device, and the suspension line attachment being in vertical alignment to provide a balanced foil. The devices function when the vessel is under way and when the vessel is stationary. The hydrodynamic force provides tension in the suspension lines which serves to damp the tendency of the vessel to roll while under way. The hydrodynamic force assures that the devices will not suddenly lose their damping effect or loose control and jerk or breach. When not under way, rolling is damped by differential resistance of the devices to upward movement through the water.

16 Claims, 2 Drawing Sheets

MARINE ANTI-ROLL DEVICE

This application is a continuation-in-part of application Ser. No. 054,838, filed 27 May 1987, now abandoned.

TECHNICAL FIELD

This invention relates to anti-roll system submersible devices for reducing rolling motion of vessels. Such devices variously are known as "stabilizers", "paravanes", "flopper stoppers", or "birds".

BACKGROUND

Over the centuries there have been numerous efforts to reduce rolling of ships and boats. The efforts range from the simplicity of a submerged bucket rigged outboard of a small boat when not under way to elegant automatic gyroscopically controlled articulated underwater ship stabilizer fins. Although adaptable to larger or smaller vessels, the present invention is disclosed in the context of offshore commercial fishing vessels, and in particular, of trawlers having outrigger booms which extend outboard athwartship. The outrigger booms are used to rig the troll lines for fishing as the boat trolls forward.

The prior art has taken advantage of the presence of outriggers on trawlers to rig devices generally called "stabilizers" or "birds" which, in practice, function merely by means of frictional drag to damp rolling of the boat. One commercially available device of this sort is described in U.S. Pat. No. 2,561,539 to Seward. Seward discloses a pair of delta shaped metal plates with a weight at the forward apex or nose of each. A mast or pylon extends upwardly from the delta plate. The pylons of these stabilizer devices each are rigged to a line which extends downwardly from the outriggers on each side of the boat. As the boat rolls to starboard, the port stabilizer device is said to remain horizontal (reason not disclosed) and resists upward movement as the line rigged to it is pulled upwardly. The starboard stabilizer line slacks and that stabilizer device tips downwardly because the nose weight places the center of gravity forward of the suspension line attachment point. It descends freely. As the boat begins to roll oppositely, the roles of the stabilizers reverse and the starboard device resists upward movement as the port device descends freely. The resistance to upward movement dampens the tendency to roll. The devices of the Seward patent are said also to function as the boat moves forward at trolling or cruising speeds, but require a change in attachment of the suspension line for each different speed.

In practice, stabilizer devices of the sort described by Seward do not remain horizontal during upward rolling movement. The only tendency to remain horizontal is due to the balancing of the drag force due to the wing area by the nose weight. If a high upward force is encountered, the balance will be overcome and the device suddenly will tip into a nose-up, near vertical attitude which offers little resistance. The result is a sudden extinction of damping and the boat rolls suddenly. The effect is undesirable. While underway, the affected device or "bird" rapidly "flies" upwardly and may breach or jump out of the water. On occasion, the affected prior art device may crash into, or even come aboard the vessel. FIG. 5 illustrates this kind of prior art device.

U.S. Pat. No. 3,260,232 to Douglas discloses a pair of outrigger borne stabilizer devices which resemble a model airplane of the sort controlled by a pair of wires. The devices disclosed by Douglas have symmetrical airfoil wings, a body or fuselage, and aft have a tail empennage of a vertical fin and a horizontal fin. A nose-heavy attitude and upward water-flow force exerted on the after empennage of the device on the side toward which the boat rolls causes it to dive. The wing-like portions are to act hydrodynamically as the boat moves forward. A pair of suspension wires spaced fore and aft together with the tail empennage are to cause the device to alter attitude (angle of attack or angle of incidence) depending upon which way the boat rolls. While under way, the objective is to cause the device to tend to "fly" downwardly when the roll is upwards and to use the downward hydrodynamic "lift" to resist the roll. Under conditions of no relative water flow, as when adrift, the device offers only the drag resistance of its area to dampen rolling.

U.S. Pat. No. 3,505,968 to Gorman discloses a moveable asymmetric foil keel or centerboard which mechanically can be oriented with respect to a sail boat to resist heeling or to help lift the hull when running before the wind.

U.S. Pat. No. 2,589,312 to Wilcoxon shows a protector paravane or "kite" intended to be towed at a maximum distance aft of, and laterally outboard from the vessel and in a vertical or on edge attitude. A depth control wing is actuated by a pressure bellows to control depth. The center of gravity is said to be forward of the center of drag pressure. In essence, it is a depth controlled drag device intended to hold the end of the tow cable far from the vessel very much like a child's kite holds the kite end of the string away from the child.

BRIEF DESCRIPTION OF THE INVENTION

The present invention is s hydrodynamic anti-roll system for use by boats having, or being adaptable to have, booms or outriggers which can be rigged to extend outboard from both sides of the vessel. It is particularly suited to commercial fishing vessels rigged with outriggers for trolling. According to the present invention, a pair of submerged hydrodynamic foil negative "lift" devices are suspended from lines rigged to the outrigger booms of the vessel. The devices have an asymmetrical airfoil shape arranged to provide a downward hydrodynamic force due to the Bernoulli effect. Under the dynamic conditions of the vessel being under way, the relative motion of the lower surface of the foil with respect to the water causes a hydrodynamic force with a downward vector component which acts through the suspension line cable and outrigger moment arm to oppose the rolling of the vessel.

Under static conditions, rolling of the vessel is damped by the resistance to upward movement offered by the area of the submerged foil device. A bridle of two lengths of chain, cable, or a rod and chain or cable, connects the device to the suspension line and functions when the vessel is not under way to present a horizontal area for hydrodynamic resistance to rolling. The bridle keeps the device in a horizontal attitude as rolling causes it to be hauled upwardly. Downward movement is unopposed as the bridle allows the device freedom to tilt. The foil device on the side toward which the vessel rolls experiences a slack suspension line. Because the device has more surface area behind the suspension attachment point, it tilts downwardly and dives as deeply as the slack of the suspension line will allow. In addition, as the foil again is pulled upwardly, the relative flow of water with respect to the curved lower surface of the foil causes a hydrodynamic force having a downward vector component. The sum of these forces acts through the suspension line and the moment arm of the outrigger further to oppose the roll of the vessel. Because the foils of the present invention are dynamic force devices rather than merely gravity balanced resistance devices, the foils when moved with respect to the water, experience a downward force vector component. The hydrodynamic force acts whenever the vessel rolls, even when the vessel is not under way. Because of that hydrodynamic force, the foils of the present invention do not tip or upset suddenly to lose resistance to rolling, nor do they jerk or breach when under way.

DETAILED DESCRIPTION OF A PREFERRED EMBODIMENT OF THE BEST MODE CONTEMPLATED BY THE APPLICANT

Figure 1:
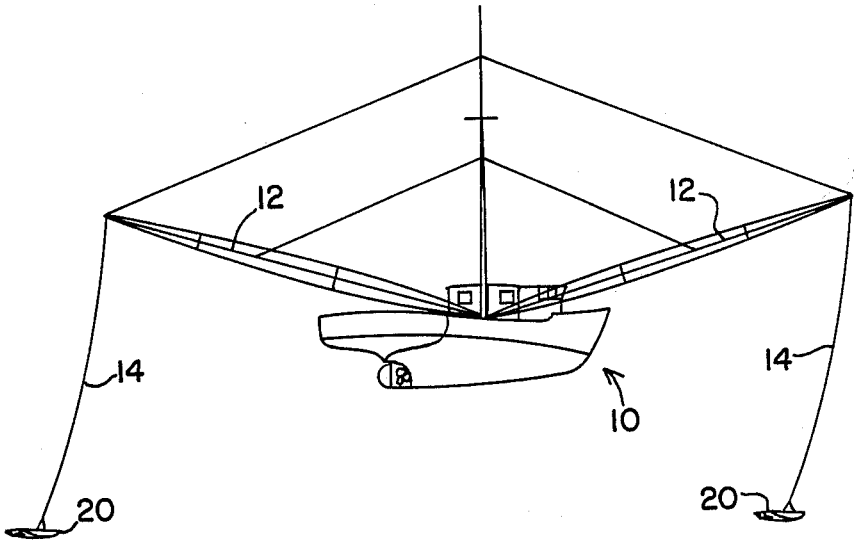
FIG. 1 is a perspective view, from underwater, of a vessel under way and making use of the present invention.

FIG. 1 is a perspective view, from below the surface of the water, of a fishing vessel 10 of the sort commonly employed, with appropriate rigging modifications, for different fisheries in both the Pacific and Atlantic Oceans. Outrigger booms 12 are shown rigged outboard and athwartship of the vessel. Outrigger booms commonly are used for trolling to separate plural fishing lines (not shown). A pair of stabilizer foil device suspension lines 14 extend from the outboard ends of outrigger booms 12 to a pair of foil devices 20 in accordance with the present invention. The stabilizer suspension lines 14 may be rope, wire rope, or chain. The foil devices 20 are secured to the ends of the lines 14 by means of a sling or bridle 15 comprising two lengths of cable or chain, or a rod and chain as is shown.

FIG. 1 illustrates the vessel 10 under way with the foil devices 20 trailing slightly due to the resistance of the water. Generally, the foil devices 20 are set to be about 5–10 meters below the surface if the vessel were stationary. The span of the outriggers approximates the length of the vessel. The foils operate outside the region of significant influence of the bow pressure wave. The foil device is balanced to hang in a horizontal attitude with no tension on the rear bridle chain 17.

Figure 2:
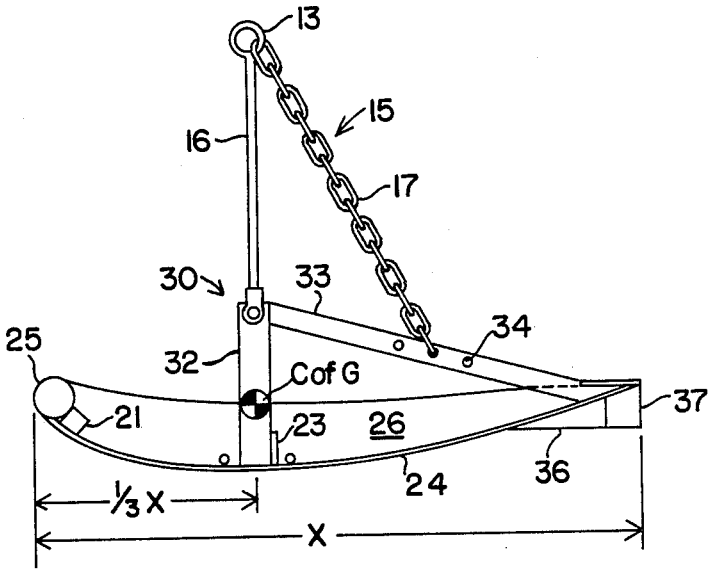
FIG. 2 is a cross-sectional view of one embodiment of a foil device according to the present invention.

FIG. 2 shows one of the foil devices 20 in greater detail. The device preferably is fabricated from sheet steel by welding. The foil surface is a sheet 24 curved in a shape resembling a high lift airplane wing airfoil. Side panels 26 are cut to the desired shape and joined to the foil surface sheet 24. A round bar 25 forms the nose or leading edge and provides balancing mass as well as resistance to impact. A further bar 21 adds balancing mass and rigidity. A transverse plate 23 stiffens the structure and provides a secure attachment means for central the pylon structure 30. The pylon 30 comprises a vertical mast member 32 and a brace member 33. Because the upper side of the foil device 20 is open, the foil is asymmetrical. The asymmetrical shape produces a hydrodynamic force acting generally normal to the foil surface 24.

The vertical mast 32 of the pylon structure 30 is located approximately one third of the chordal span (X) aft from the leading edge of the foil device 20 and directly above the center of gravity. The bridle assembly 15 comprises an attachment ring 13 to which is secured a fore stay 16 which preferably is a rigid rod and a flexible after stay 17 which may be chain or cable. The stabilizer suspension line 14 is to be secured to the attachment ring 13. The stays 16, 17 are attached to the submersible foil surface 24 at locations spaced apart longitudinally and located centrally of the upper side of the submersible foil surface. The relative lengths of the fore stay 16 and after stay 17 are such that the foil, at rest, hangs horizontally from the suspension line 14, in static balance, with no tension in the after stay 17. Several mounting holes 34 in the pylon structure 30 permit adjustment of the location of the after stay 17.

Figure 4:
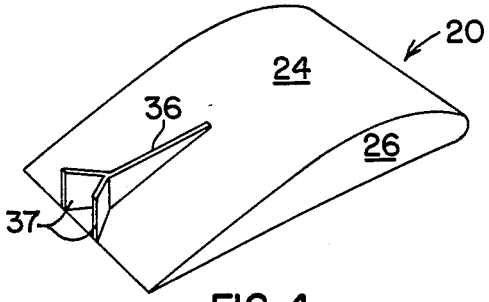
FIG. 4 is a perspective view, from below, of the foil device of FIG. 2.

Referring now to FIG. 4, the foil device 20 of the present invention is seen from below (or upside down). A skeg 36 extends aft centrally of the foil surface 24 to a pair of divergent fin surfaces 37 which terminate near the trailing edge of the foil device. The skeg and divergent fin surfaces 36,37 act somewhat like the fletching of an arrow to prevent the foil device 20 from yawing or "hunting" from side to side as it is moved through the water. For a commercial fishing vessel of about 30 meters length, each foil device is somewhat less than a meter long, about ⅔ meter wide, and weighs about 48 kilos.

Figure 3A:
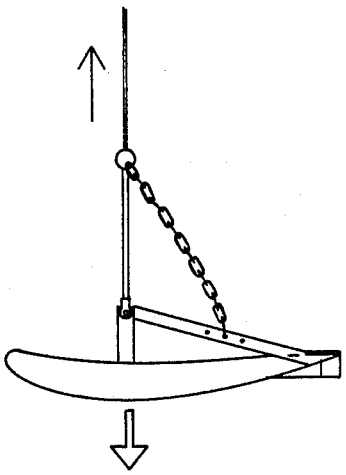
FIG. 3A shows the device during an upward roll.

As is shown in FIG. 3A, water flow with respect to the foil surface 24 of the foil device 20 operates according the Bernoulli principal to provide a hydrodynamic force. Because of the asymmetry of the device, that is, the curved foil surface is on the underside, the hydrodynamic force is generally normal to that surface and thus is a downward, dynamic force (indicated by a downward arrow in FIG. 3A) which can be viewed as negative lift. Because of the airfoil shape, the downward hydrodynamic force acts as if it were centered at a point approximately one third of the chordal span distance from the leading edge and in vertical alignment with the center of gravity of the device. That is, the center of lift and the center of gravity are in vertical alignment with the suspension bridle fore stay 16. That downward force is opposed by the suspension line 14 which is tensioned thereby.

Figure 3B:
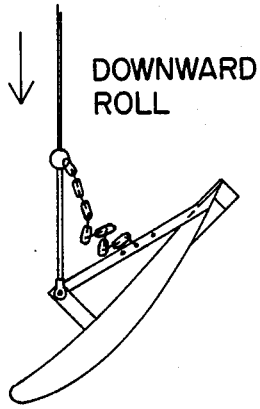
FIG. 3B shows the device during a downward roll.

As is shown in FIG. 3B, the foil on the side toward which the vessel rolls also is free to tilt downwardly and dive in response to slacking of the suspension line 14 thereby reducing the force exerted by that foil. The result is a differential of downward force between the foils of the pair, with the greater downward force being exerted by the foil away from which the vessel tends to roll. The roll is opposed and damped. Since there are a pair of foils, one on either side of the vessel, and their action is realized through the relatively long moment arm of the outrigger booms 12, rolling of the vessel is reduced. In a sense, the vessel is stabilized. Any further tendency of the vessel to roll causes one of the foils forcibly to be hauled upwardly through the water, thereby offering a frictional drag resistance and also increasing the flow velocity over the surface 24 of that foil to thereby further increase the downward force exerted by that foil.

As the velocity of the vessel with respect to the water increases, the downward hydrodynamic force increases. The suspension line 14 trails aft assuming a catenary curve which tends to increase the negative angle of incidence of the foil 20 with respect to the horizontal. The hydrodynamic force exerted by the foil in this diving attitude then tends to increase the tension in the cable, lessening the catenary curve, which results in driving the foil forward, thereby restoring a lesser angle of negative incidence and reduced cable tension. A stable status is achieved which keeps the foil well below the surface to avoid breaching. The foil assumes a stable position fairly far forward, generally directly below or slightly aft of the attachment of the line 14 to the outrigger. The foil remains nearly horizontal with the result of greatly reduced drag when compared with other stabilizer devices.

Figure 6:
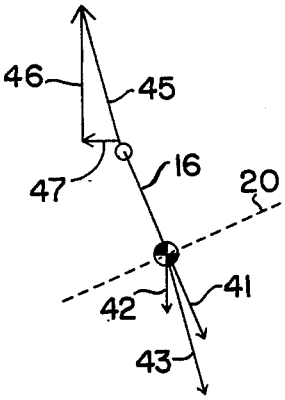
FIG. 6 is a vector diagram showing some of the forces involved.
Figure 5:
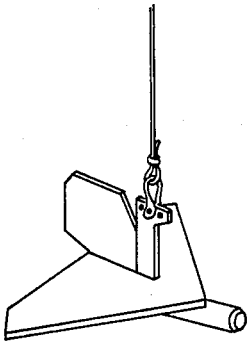
FIG 5 (PRIOR ART)
FIG. 5 is a perspective view, from above, of a commercially available stabilizer device of the prior art.

FIG. 6 is a vector diagram showing the forces which act as the vessel moves forward. In FIG. 6, the tension in the suspension line is represented by force vector 45. The suspension line force represented by vector 45 acts on the forward stay 16 of the bridle. Force vector 45 may be resolved into upward and forward force components 46,47. The suspension line force vector 45 exactly is opposed by vector 43 which represents the force provided by the foil device 20. Vector 43 can be resolved into force component vectors 41, 42. Force component 41 represents the hydrodynamic force or negative lift provided by the foil device 20. Force component 42 represents the gravity force due to the weight of the device. The foil device moves in response to these vector components to move downwardly and horizontally.

When there is little or no motion of the vessel with respect to the water, that is, when drifing or at anchor with no current, rolling of the vessel is damped by the frictional drag resistance of the area of the foil 20 to being hauled upwardly by the suspension line 14 on the side away from which the vessel rolls. On the upward haul, after stay 17 maintains the foil device in a horizontal attitude. In addition, as the foil is hauled upwardly through the water, the relative flow of water over the foil surface 24 again causes a hydrodynamic force having a vector component opposed to the roll. The foil on the side toward which the vessel rolls dives deeper in the water. The flexibility of the chain or cable 17 allows that foil to descend when the suspension line 14 becomes slack. As is shown in FIG. 2, the center of gravity is located about ⅓ of the chord (X) of the foil. The greater surface area aft of the center of gravity causes the foil to tilt downwardly, as is shown in FIG. 3B, thereby reducing frictional resistance to promote descent of the foil when the suspension line 14 becomes slack.

The foil devices according to the present invention utilize hydrodynamic forces at all times to keep the foils from suddenly loosing resistance to rolling of the vessel as well as to keep the foils from uncontrolled conduct such as breaching or striking the vessel.

I claim:

1. An anti-roll system for a vessel having first and second outrigger booms extending outboard from the sides of the vessel comprising:

first and second submersible marine stabilizer devices to be suspended from the ends of the respective outrigger booms by suspension lines secured to the ends of said booms;

each stabilizer device comprising a sheet of structural material formed into a single curved foil shaped plate with a leading end and a trailing end and side edges, the curved foil shaped plate being oriented to form an effective asymmetric hydrodynamic foil surface on the bottom of the stabilizer device, side panels secured to the side edges of the sheet leaving the top of the stabilizer device open, and balancing mass means formed at the leading end of the foil shaped plate so that the center of mass of the stabilizer device is located along the chord distance from the leading end to the trailing end of the plate approximately one-third of said chord distance from the leading end;

a pylon structure comprising a mast secured to the top of the stabilizer device substantially centered between the side panels, said mast being positioned along the chord distance from the leading end to the trailing end of the foil shaped plate approximately one-third of said chord distance from the leading end so that the mast extends upward from approximately the center of gravity of the stabilizer device, said pylon structure being rigidly and integrally secured to the stabilizer device;

and a bridle structure coupled to the pylon structure, said bridle structure comprising a forestay pivotally coupled to the top of the mast, and a flexible afterstay secured to the stabilizer device between the forestay and the trailing end of the curved foil shaped plate, said forestay and afterstay being joined together adjacent to the respective top ends, with suspension line coupling means adjacent to said top ends of the forestay and afterstay for coupling to a suspension line, the length of the flexible afterstay relative to the forestay being selected so that the stabilizer device at rest hangs substantially horizontally from a suspension line with substantially no tension on the afterstay, said flexible afterstay having a length which maintains the orientation of the stabilizer device substantially perpendicular to the suspension line during upward movement, said flexible afterstay permitting a diving orientation of the stabilizer device during downward movement.

2. The anti-roll system of claim 1 wherein the pylon structure further comprises a mast brace secured to the mast and to the foil shaped plate, said mast brace extending from the mast toward the trailing end of the foil shaped plate, and wherein the flexible afterstay of the bridle structure is secured to the mast brace, said forestay, afterstay and mast brace forming a generally triangular configuration.

3. The anti-roll system of claim 1 further comprising first and second suspension lines to be secured to the ends of the first and second outrigger booms extending outboard from the sides of the vessel, said suspension lines having sufficient length to suspend the first and second stabilizer devices in the range of approximately 5 to 10 meters below the surface of the water when the vessel is stationary relative to the water surface.

4. The anti-roll system of claim 3 further comprising outrigger booms having a span between the respective ends of the outrigger booms of substantially the length of the vessel for holding the stabilizer devices in the water outside the region of substantial influence of the bow wave of the vessel when the vessel is underway.

5. The anti-roll system of claim 1 wherein the forestay of the bridle structure comprises a rigid bar or rod pivotally coupled to the top of the mast.

6. The anti-roll system of claim 5 wherein the afterstay comprises a chain coupled at one end to the top of the rigid bar forestay and at the other end adjacent to the trailing end.

7. The anti-roll system of claim 1 wherein the balancing mass means comprises at least one bar secured to the curved foil plate across the leading end and forming a portion of the leading end and the asymmetric hydrodynamic foil surface.

8. The anti-roll system of claim 1 wherein the bottom of the shaped foil plate providing an asymmetric hydrodynamic foil surface is formed with a skeg centered between the side panels and extending toward the trailing end of the curved foil plate.

9. An anti-roll system for a vessel having first and second outrigger booms extending outboard from the sides of the vessel comprising:

first and second submersible marine stabilizer devices suspended from the ends of the respective outrigger booms by suspension lines secured to the ends of said booms;

first and second suspension lines having sufficient length to suspend the stabilizer devices in the range of approximately 5 to 10 meters below the surface of the water when the vessel is stationary relative to the water surface;

said outrigger booms having a span substantially the length of the vessel for holding the stabilizer devices in the water outside the region of substantial influence of the bow wave of the vessel when the vessel is under way;

each stabilizer device comprising a sheet of structural material formed into a single curved foil shaped plate with a leading end and a trailing end and side edges, the curved foil shaped plate being oriented to form an effective asymmetric hydrodynamic foil surface functional on the bottom of the stabilizer device, side panels secured to the side edges of the sheet leaving the top of the stabilizer device open, and balancing mass means formed at the leading end of the foil shaped plate so that the center of mass of the stabilizer device is located along the chord distance from the leading end to the trailing end of the plate approximately one-third said chord distance from the leading end;

a pylon structure comprising a mast secured to the top of the stabilizer device substantially centered between the side panels, said mast being positioned along the chord distance from the leading end to the trailing end of the foil shaped plate approximately one-third said chord distance from the leading end so that the mast extends upward from approximately the center of gravity of the stabilizer device, said pylon structure further comprising a mast brace secured to the mast and to the foil shaped plate, said mast brace extending from the mast toward the trailing end of the foil shaped plate, said pylon structure being rigidly and integrally secured to the stabilizer device;

and a bridle structure coupled to the pylon structure, said bridle structure comprising a rigid forestay pivotally coupled to the top of the mast and a flexible afterstay secured to the mast brace, said forestay and afterstay being joined together adjacent to the respective top ends, with suspension line coupling means adjacent to said top ends for coupling to a suspension line, the length of the flexible afterstay relative to the pivotally mounted rigid forestay being selected so that the stabilizer device at rest hangs substantially horizontally from a suspension line with substantially no tension on the afterstay, said flexible afterstay having a length which maintains the orientation of the stabilizer device substantially perpendicular to the suspension line during upward movement of the stabilizer device, said flexible afterstay permitting a diving orientation of the stabilizer device during downward movement.

10. A marine anti-roll system for resisting the rolling of a vessel comprising:

a pair of suspension lines (14) on either side of the vessel, and outrigger means to attach the pair of suspension lines (14) outboard and abeam of the sides of the vessel, a pair of submersible devices (20) for attachment to the suspension lines (14) secured to the outriggers on the vessel to place the suspension lines outboard and abeam of the vessel, the device having curved foil surfaces (24) for producing a hydrodynamic negative lift force in consequence of relative movement of the foil surface with respect to water, the center of hydrodynamic negative lift being located aft of the leading edge of the device approximately one-third of the chordal length of the foil surface, the devices being balanced to bring the center of gravity of the devices into vertical alignment with the center of hydrodynamic lift, for each device, a bridle (15) comprising a fore stay (16) and a flexible after stay (17) to suspend the foil surface with respect to a suspension line (14), the fore stay (16) of the bridle being secured to the device directly above the center of hydrodynamic lift of the foil surface and in vertical alignment with the center of gravity of the device, whereby forward movement of the device with respect to the water will establish tension in the suspension line (14), the after stay (17) serving to keep the device oriented generally perpendicular to the suspension line (14) when the device is hauled upwardly as the vessel rolls.

11. A marine anti-roll system for resisting the rolling of a vessel comprising:

a submersible device (20) for attachment to a suspension line (14) secured to an outrigger on the vessel to place the suspension line outboard and abeam of the vessel, the device having a curved foil surface (24) for producing a hydrodynamic negative lift force in consequence of relative movement of the foil surface with respect to water, the center of hydrodynamic negative lift being located aft of the leading edge of the device approximately one-third of the chordal length of the foil surface, the device being balanced to bring the center of gravity of the device into vertical alignment with the center of hydrodynamic lift, a bridle (15) comprising a fore stay (16) and a flexible after stay (17) to suspend the foil surface with respect to a suspension line (14), the fore stay (16) of the bridle being secured to the device directly above the center of hydrodynamic lift of the foil surface and in vertical alignment with the center of gravity of the device, whereby forward movement of the device with respect to the water will establish tension in the suspension line (14), the after stay (17) serving to keep the device oriented generally perpendicular to the suspension line (14) when the device is hauled upwardly as the vessel rolls.

12. The system of claim 11 wherein the foil surface (24) is asymmetrical to produce a hydrodynamic force acting generally normal to the foil surface.

13. The system of claim 11 wherein the fore stay (16) and the after stay (17) are attached to the submersible foil surface (24) at locations spaced apart longitudinally and located centrally of the upper side of the submersible foil surface (24).

14. The system of claim 11 wherein the bridle (15) is attached to a pylon structure (30) comprising a vertical mast member (32) and a brace member (33).

15. The system of claim 14 wherein the asymmetrical foil surface (24) includes on the outer, lower surface a skeg (36) which extends aft centrally of the foil surface (24) to a pair of divergent fin surfaces (37) which terminate near the trailing edge of the submersible foil surface.

16. The system of claim 11 further comprising a pair of submersible devices (20) and a pair of suspension lines (14), on either side of the vessel.

* * * * *